US008516939B1

(12) United States Patent
Basak et al.

(10) Patent No.: US 8,516,939 B1
(45) Date of Patent: Aug. 27, 2013

(54) ELECTROMAGNETIC RESTRAINT RELEASE DEVICE, SYSTEM AND METHOD

(75) Inventors: Leszek S. Basak, Nottingham, MD (US); Lawrence M. Hetzel, Fallston, MD (US); William Kraft, Forest Hill, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 29 days.

(21) Appl. No.: 13/363,612

(22) Filed: Feb. 1, 2012

Related U.S. Application Data

(63) Continuation of application No. 13/307,514, filed on Nov. 30, 2011, now abandoned.

(51) Int. Cl.
*F41F 3/04* (2006.01)

(52) U.S. Cl.
USPC ..... 89/1.806; 89/8; 124/3

(58) Field of Classification Search
USPC ..... 89/8, 1.806; 124/3
See application file for complete search history.

(56) References Cited

U.S. PATENT DOCUMENTS

| | | | | |
|---|---|---|---|---|
| 3,754,496 | A | 8/1973 | Noel | |
| 3,813,984 | A | 6/1974 | Selinder | |
| 3,910,154 | A | 10/1975 | Gardner | |
| 3,926,090 | A | 12/1975 | Bunker | |
| 4,181,062 | A | 1/1980 | Bernstein et al. | |
| 4,187,759 | A | 2/1980 | Toy et al. | |
| 5,221,171 | A | 6/1993 | Rudoy et al. | |
| 5,282,709 | A | 2/1994 | Chaput et al. | |
| 5,997,230 | A | 12/1999 | Dodd et al. | |
| 6,311,930 | B1 * | 11/2001 | Hersh et al. | 244/172.9 |
| 6,650,212 | B1 * | 11/2003 | Weems | 335/285 |
| 7,340,986 | B1 * | 3/2008 | Gaigler | 89/1.806 |
| 7,647,857 | B2 | 1/2010 | Gaigler et al. | |
| 7,703,373 | B2 * | 4/2010 | Gaigler et al. | 89/8 |
| 7,895,931 | B2 * | 3/2011 | Gaigler et al. | 89/8 |
| 7,966,922 | B2 | 6/2011 | Gaigler et al. | |
| 8,042,447 | B2 * | 10/2011 | Skurdal et al. | 89/8 |
| 2002/0053278 | A1 * | 5/2002 | Hayes et al. | 89/1.34 |
| 2006/0027083 | A1 | 2/2006 | Lee et al. | |
| 2007/0234893 | A1 * | 10/2007 | Lockner et al. | 89/8 |
| 2010/0263648 | A1 * | 10/2010 | Basak et al. | 124/3 |
| 2011/0011252 | A1 | 1/2011 | Gaigler et al. | |
| 2012/0167750 | A1 * | 7/2012 | Gaigler et al. | 89/33.1 |

* cited by examiner

*Primary Examiner* — Michael David
(74) *Attorney, Agent, or Firm* — Miles & Stockbridge PC

(57) ABSTRACT

Restraint release devices, systems and methods may enable actuation of a release function without using chemically energetic or thermally sensitive devices, and may employ an electromagnetic (EM) force to mechanically separate components of a fastener. A pulsed power system having a capacitive discharge circuit may be used to supply an electric current pulse to generate the EM force. The EM force can be applied to a retaining wire that surrounds and holds intact a segmented fastener. The EM force may cause the retaining wire to increase in length, thereby relaxing its hold on the segmented fastener and allowing the segments to separate and release the restraint mechanism. Restraint mechanisms using such EM restraint release devices, systems and methods may not need periodic recertification or replacement of energetics and may not have a risk of cook-off resulting from heat soak of thermally sensitive devices during operational and fault scenarios.

24 Claims, 6 Drawing Sheets

ELECTROMAGNETIC RESTRAINT RELEASE DEVICE, SYSTEM AND METHOD

The disclosed subject matter relates generally to the field of restraint mechanisms for deployable systems. More specifically, the disclosed subject matter relates to devices for releasably restraining objects that are to be launched, fired or otherwise deployed, and systems and methods for using the same.

A projectile or other object that is to be launched, fired or otherwise deployed is often stored, shipped, and carried to its point of deployment in a canister. Examples of such deployable objects include missiles, various munitions, launch vehicles, satellites, space vehicles, and various subsystems or components of each. Securing the deployable object to a canister or launch container protects the deployable object from damage when the object is subjected to various potentially harsh environmental conditions during, for example, shipping, handling, and storage and launch operations.

Restraint mechanisms are typically used to secure or couple the deployable object to its canister or launch container. When the object is to be deployed, the restraint mechanism is actuated to release or decouple the object from its canister or launch container. Traditional restraint mechanisms may employ chemically energetic or thermally sensitive materials to operate the release function of the restraint mechanism. Use of these materials, however, may be accompanied by several drawbacks. Energetic materials such as pyrotechnic devices can be costly, can require periodic certification or replacement, have limited shelf life, and are heat sensitive. Such devices also introduce energetic materials into the canister or launch container, which can leave residue or other material behind after their actuation during deployment. This residual material must be removed prior to a subsequent launch or deployment. Finally, pyrotechnic devices are susceptible to cook-off as a result of, for example, a restrained firing event or magazine fire heat soak. Thermally sensitive materials such as those used with shape memory alloy (SMA) actuators can be costly and are heat sensitive. SMA devices are also susceptible to cook-off as a result of, for example, a restrained firing event or magazine fire heat soak. Special design provisions may necessarily be considered to ensure restraint system integrity during various operational and fault conditions.

The restraint release devices, systems and methods of the disclosed subject matter may enable actuation of a restraint release system without the use of chemically energetic (e.g., pyrotechnic) or thermally sensitive (e.g., SMA) devices. Restraint release systems according to embodiments of the disclosed subject matter may employ an electromagnetic force—otherwise known as Lorentz Force—to mechanically separate components of a restraint release system fastener and locking device. This may include the use of a pulsed power system having a capacitive discharge circuit to supply an electric current pulse to generate the electromagnetic (EM) force. The EM force can be applied to a retaining band, ring or wire that encompasses or surrounds and holds intact a fastener such as, for example, a segmented nut. Application of the EM force may cause a diameter or outer periphery of the retaining band, ring or wire to become larger, thereby relaxing the hold on the segmented nut and allowing segments of the nut to separate and thus release the restraint mechanism. Restraint mechanisms that use the EM restraint release devices, systems and methods of the disclosed subject matter may not need periodic recertification of energetics, may not have the risk of cook-off resulting from heat soak of thermally sensitive devices during operational and fault scenarios including restrained firing events, launcher compartment fires, and battle damage, and may provide good overall safety and reliability across launcher operational and fault environments.

In one or more exemplary embodiments, an electromagnetic device may releasably engage a threaded male member in a restraint mechanism, and the device may include a plurality of threaded segments arranged radially around a central axis in grouped relation to form an internally threaded through hole for receiving and holding the male member, and may also include a retaining member wrapped circumferentially around the plurality of segments to hold the plurality of segments in the grouped relation and configured to receive an electric current.

In response to a flow of electric current, the retaining member may release its hold on the plurality of segments, and the plurality of segments in turn may release its hold on the male member. Also in response to the flow of electric current and a resulting electromagnetic force, a first outer peripheral dimension of the retaining member may be changed to a larger second outer peripheral dimension. The retaining member may include at least one fusible link, and in response to the flow of electric current, at least a portion of the retaining member corresponding to the fusible link may be disintegrated.

Optionally, the retaining member may be placed within a recess formed in the outer periphery of the plurality of segments.

In one or more exemplary embodiments, a electromagnetic restraint release system may be configured for releasably restraining a deployable object, and the restraint release system may include a housing for restraining the deployable object, the housing including a mating portion for connecting to the deployable object; a clamping member for holding the mating portion of the housing to a corresponding portion of the deployable object, the clamping member having a through hole for receiving a threaded male member; a threaded segmented female member having a plurality of segments grouped radially around a central axis to form a threaded through hole for receiving and holding the male member in releasable engagement; a retaining wire disposed around an outer periphery of the plurality of segments to bind the plurality of segments together and configured to receive an electric current; and a discharge circuit configured to flow electric current through the retaining wire, where in response to a flow of electric current, the retaining wire may release its bind on the plurality of segments, and the plurality of segments in turn may release its engagement with the male member.

In response to the flow of electric current and a resulting electromagnetic force, a first outer peripheral dimension of the retaining wire may be changed to a larger second outer peripheral dimension. Additionally, at least a portion of the retaining wire may be disintegrated.

Optionally, the retaining wire may be disposed within a recess formed in the outer periphery of the plurality of segments.

The discharge circuit may include a pulsed power system adapted to drive electromagnetic functions of the restraint release system.

The deployable object may be one of a projectile, missile, launch vehicle, and space vehicle.

In one or more exemplary embodiments, a method may include: providing an electromagnetic restraint release system configured for releasably restraining a deployable object, the restraint release system including: a housing for restraining the deployable object, the housing including a mating portion for connecting to the deployable object; a clamping member for holding the mating portion of the housing to a corresponding portion of the deployable object, the clamping member having one or more through holes for receiving a threaded male member; a threaded female member having a plurality of segments grouped radially around a central axis to form a threaded through hole for receiving and holding the male member in releasable engagement; a retaining wire disposed around an outer periphery of the plurality of segments to bind the plurality of segments together and configured to receive an electric current; and a discharge circuit configured to flow electric current through the retaining wire. The method may further include placing the deployable object in contact with a mating portion of the housing, the deployable object being in a stowed or restrained configuration; clamping the mating portion of the housing to a corresponding portion of the deployable object using the clamping device; inserting the threaded male member through the one or more through holes in the clamping device; and placing the female member in threaded engagement with a threaded portion of the male member to secure the deployable object to the housing, thus releasably restraining the deployable object.

The method may further include flowing an electric current through the retaining wire using the discharge circuit, so that the retaining wire releases its bind on the plurality of segments, the plurality of segments are no longer grouped together, the female member is no longer in threaded engagement with a threaded portion of the male member, and the deployable object is no longer secured to the housing and is thus no longer restrained.

In accordance with the method, in response to the flow of electric current and a resulting electromagnetic force, the retaining wire may expand such that a first outer peripheral dimension of the retaining wire is increased to a larger second outer peripheral dimension.

In accordance with the method, the retaining wire may include at least one fusible link and in response to the flow of electric current, at least a portion of the retaining wire may be disintegrated.

In accordance with the method, the retaining wire may be arranged within a recess formed in the outer periphery of the female member.

In one or more exemplary embodiments, a launch system may include an electromagnetic restraint release system adapted to hold releasably a launch object, the restraint release system including: a housing for restraining the launch object, the housing including a mating portion for connecting to the launch object; a clamping member for holding the mating portion of the housing to a corresponding portion of the launch object, the clamping member having one or more through holes for receiving a threaded male member; a segmented female member having a plurality of threaded segments grouped radially around a central axis to form a threaded through hole for receiving and holding the male member in releasable engagement; a retaining wire disposed around an outer periphery of the plurality of segments to bind the plurality of segments together; and means for providing an electromagnetic force to the retaining wire, wherein response to the provided electromagnetic force, the retaining wire releases its bind on the plurality of segments, and the plurality of segments in turn releases its engagement with the male member. The means for providing an electromagnetic force may include a pulsed power system.

BRIEF DESCRIPTION OF THE DRAWINGS

The accompanying drawings are incorporated in and constitute a part of the specification.

DETAILED DESCRIPTION

While the exemplary embodiments illustrated herein may show the various features of the disclosed subject matter, it will be understood that the features disclosed herein may be combined variously to achieve the objectives of the present embodiments.

The devices, systems and methods of the disclosed subject matter may be used to remotely decouple two coupled assemblies, without using chemical energetics or thermally sensitive devices.

Figure 1:
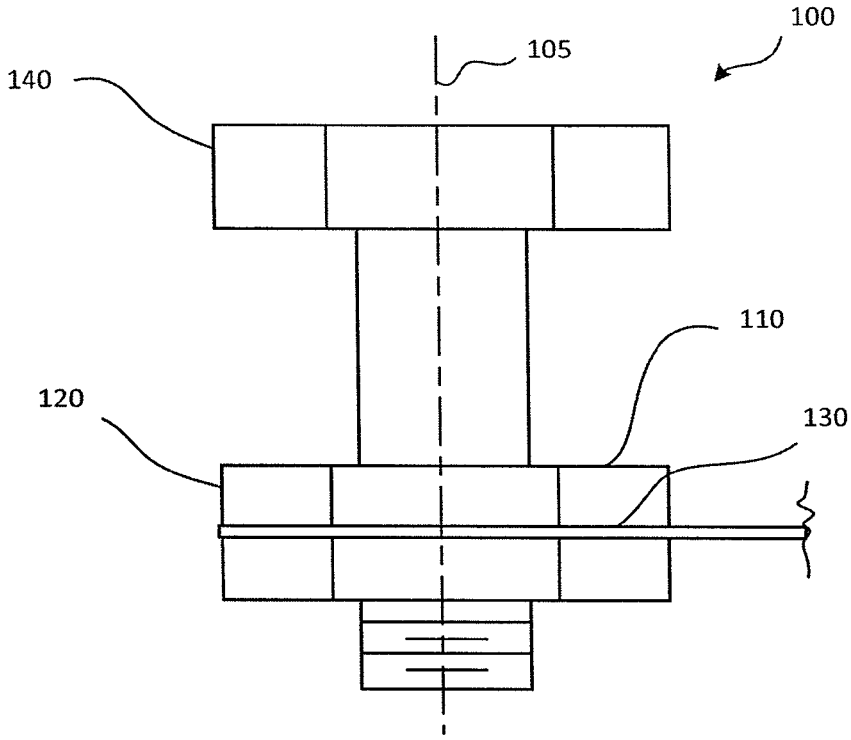
FIG. 1 shows a side view of an electromagnetic restraint release device in a restrained state according to various embodiments of the disclosed subject matter.
Figure 2:
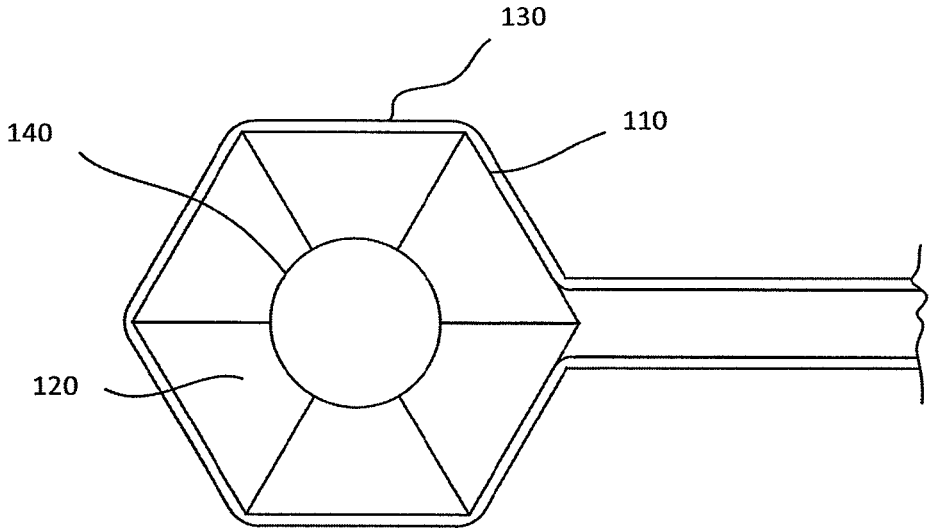
FIG. 2 shows a bottom view of an electromagnetic restraint release device in a restrained state according to various embodiments of the disclosed subject matter.

Turning to FIG. 1, a side view of an electromagnetic restraint release device 100 is shown according to various embodiments. Device 100 includes female fastener member 110, which is divided into multiple segments 120. As shown in FIGS. 1 and 2, fastener member 110 is divided into six equal segments 120. Optionally, fastener member 110 may be divided into two or more segments of equal or varying size. Segments 120 can be threaded and grouped radially around a central axis 105 of device 100 to form an internally threaded through hole for receiving and holding a threaded male fastener such as male fastener member 140 or another suitable male fastener. Accordingly, the restraint function of electromagnetic restraint release device 100 can be performed. As shown in FIGS. 1 and 2, female fastener member 110 and male fastener member 140 are configured as a hexagonal nut and bolt that are threaded for mating or engagement purposes. Optionally, fastener members 110 and 140 may be configured to engage each other via other suitable fastening mechanisms such as, for example, projection-and-recess, flange, clasp, hook-and-loop, snap, clevis, and coupler.

Figure 3:
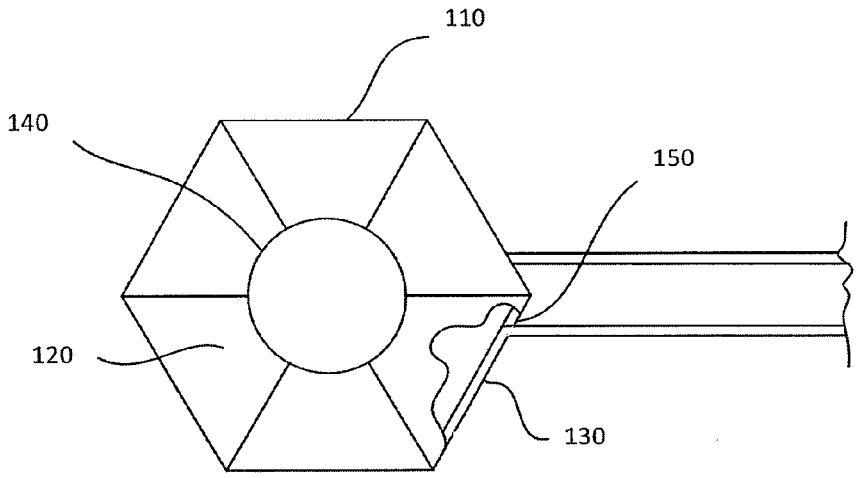
FIG. 3 shows a bottom view of an electromagnetic restraint release device in a restrained state according to various embodiments of the disclosed subject matter.

As shown in FIGS. 1 and 2, segments 120 of fastener member 110 are held or grouped together by retaining member 130, which is wrapped around the outer periphery of fastener member 110 such that fastener member 110 functions as an integral member. Retaining member 130 may be mechanically bonded to segments 120. Retaining member 130 is shown in FIGS. 1 and 2 as a wire that holds or compresses segments 120 together and rests on the outer radial perimeter of fastener member 110. Optionally, as shown in FIG. 3, retaining member 130 may be configured as a wire that fits within a recess or groove 150 in the outer surface of each segment 120, such that retaining member 130 is substantially flush with the outer surface of segments 120. This recessed configuration may provide additional clearance for a wrench, socket or other torqueing tool. Additionally, retaining member 130 may be configured as a ring or band that surrounds or encapsulates a major portion—or substantially all—of the outer peripheral surface of fastener member 110.

Figure 4:
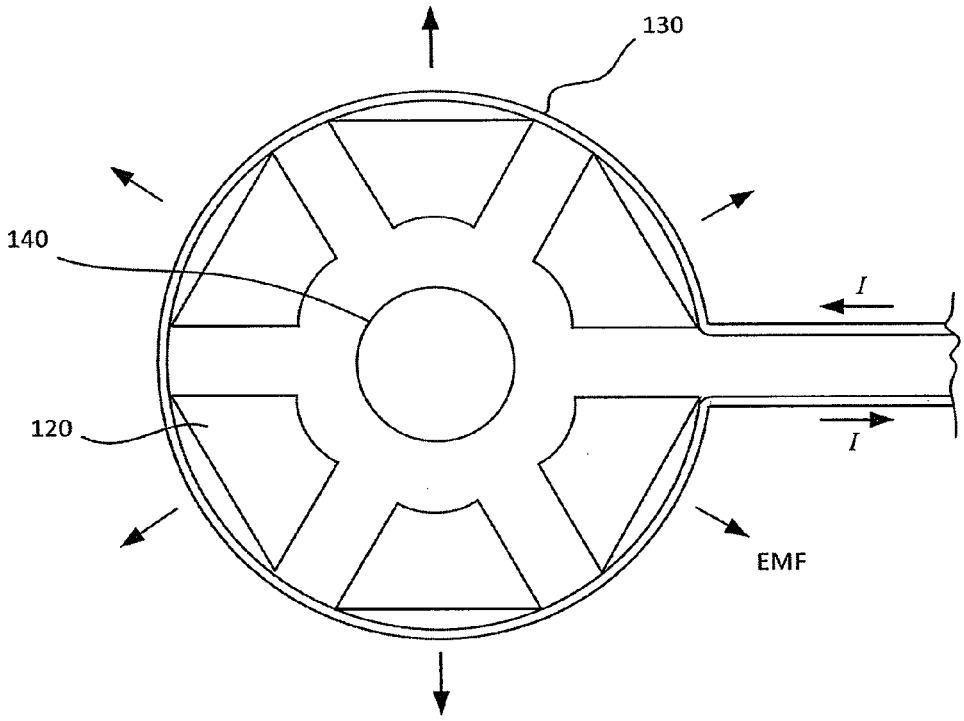
FIG. 4 shows a bottom view of an electromagnetic restraint release device in a released state according to various embodiments of the disclosed subject matter.

Retaining member 130 may be configured to receive an electric current from, for example, a discharge circuit. As is shown in FIG. 4, in response to a flow of electric current I, and the resulting electromagnetic force EMF (depicted by radial arrows), retaining member 130 can expand in length and relax its compressive hold on segments 120. In this expanded configuration, an outer peripheral dimension of retaining member 130 may be larger as compared to that of its prior restrained configuration. In lieu of the radially inward force previously exerted on segments 120, retaining member 130 may exert a radially outward force on segments 120 that may tend to pull the segments apart. Segments 120 can in turn, release their collective hold on male fastener member 140. Accordingly, the release function of electromagnetic restraint release device 100 can be actuated.

Retaining member 130 may be optionally configured with one or more fusible links (not shown). The electrical fusible link can be constructed, for example, with a relatively short section or length of retaining member 130 having a cross-sectional area that is smaller than the remainder of retaining member 130. In response to the flow of electric current, the fusible link portion of retaining member 130 can disintegrate, and further serve to relax the compressive hold retaining member 130 exerts on segments 120.

Figure 5:
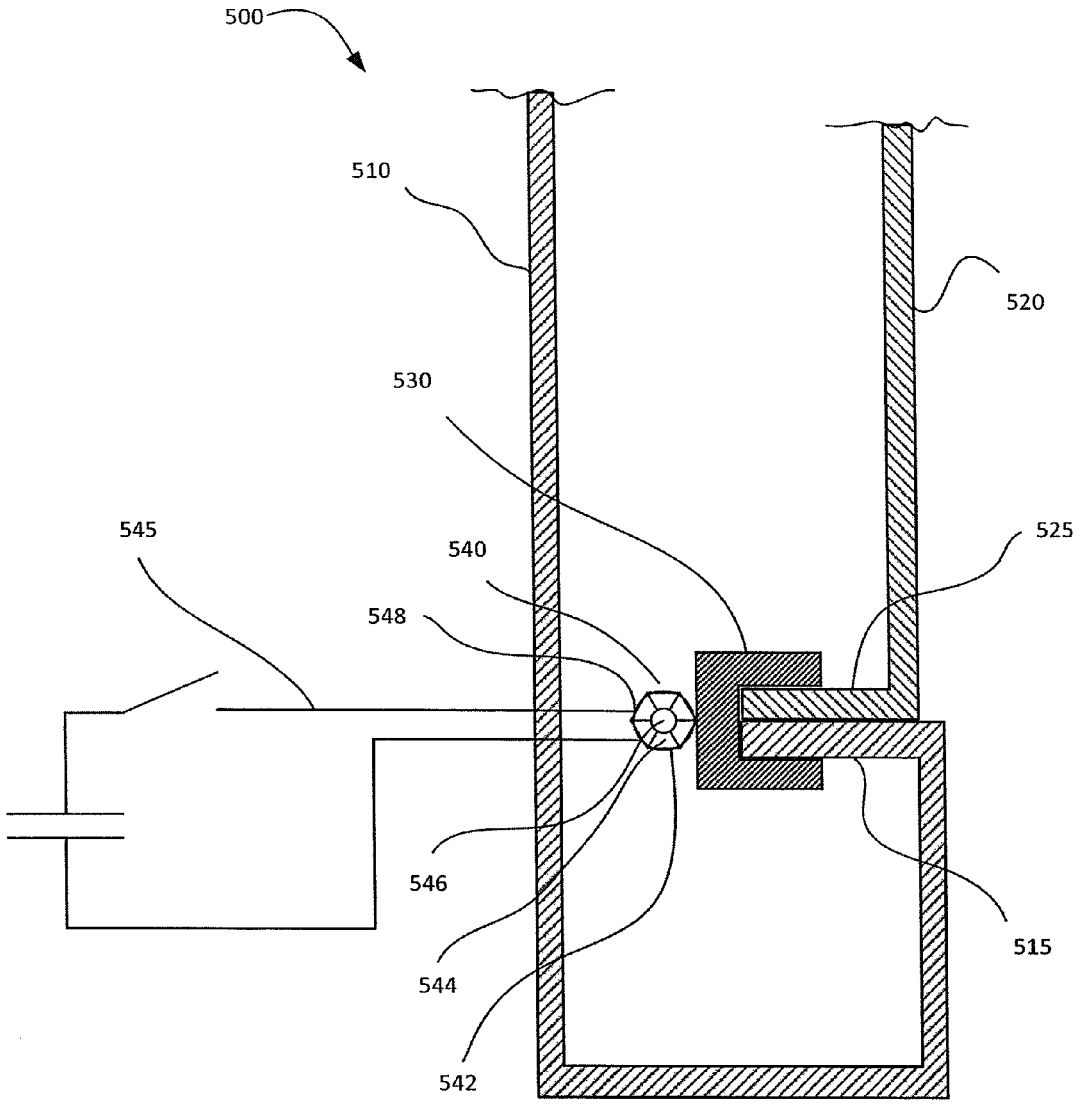
FIG. 5 shows a partial cross-sectional view depicting an exemplary implementation of an electromagnetic restraint release system according to various embodiments of the disclosed subject matter.

FIG. 5 shows a partial cross-sectional view depicting an exemplary implementation of an electromagnetic restraint release system according to various embodiments of the disclosed subject matter. The deployable system 500 depicted in FIG. 5 utilizes an electromagnetic restraint release system in lieu of, for example, a pyrotechnic release system. Deployable system 500 can include a housing 510 for restraining a deployable object 520. Housing 510 and deployable object 520 may be viewed as two assemblies that have been coupled and must be decoupled remotely before object 520 can be deployed. Housing 510 may be, for example, a canister or launch container such as a missile shroud or payload fairing. Housing 510 can include a flange or tab 515 for mating with or connecting to a corresponding flange or tab 525 of deployable object 520. System 500 can also include a clamping device 530 for holding together flange 515 and flange 525 in a mated or joined configuration. Clamping device 530 may be any device suitable for mating flange 515 and flange 525 such as, for example, a Marman clamp. Flanges 515 and 525 and clamping device 530 may include chamfers to facilitate separation of the components once released. System 500 can also include an electromagnetic restraint release system 540, which may be used in conjunction with clamping device 530 to maintain the mated or joined configuration of flange 515 and flange 525. Electromagnetic restraint release system 540 may include components that are similar or identical to device 100 depicted in FIGS. 1 and 2. Specifically, electromagnetic restraint release system 540 can include female fastener member 542, which is divided into multiple segments 544. As shown in FIG. 5, fastener member 542 is divided into six equal segments 544. Optionally, fastener member 542 may be divided into two or more segments of equal or varying size. Segments 544 can be grouped radially around a central axis to form an internal through hole for receiving and holding in releasable engagement a male fastener, such as male fastener member 546. Optionally, fastener members 542 and 546 may be internally threaded and externally threaded, respectively, to facilitate releasable engagement with one another.

Segments 544 of fastener member 542 may be bound or grouped together by retaining member 548, which is wrapped around the outer periphery of fastener member 542 such that fastener member 542 functions as an integral member. Retaining member 548 may be mechanically bonded to segments 544. Retaining member 548 is shown in FIG. 5 as a wire that binds or compresses segments 544 together and rests on the outer radial perimeter of fastener member 542. Optionally, retaining member 548 may be configured as a wire that fits within a recess or groove in the outer surface of each segment 544, such that retaining member 548 is substantially flush with the outer surface of grouped segments 544, similarly to that depicted in FIG. 3. Additionally, retaining member 548 may be configured as a ring or band (not shown) that surrounds or encapsulates a major portion—or substantially all—of the outer peripheral surface of fastener member 542.

Retaining member 548 may be configured to receive an electric current from, for example, a discharge circuit 545 of system 540. Discharge circuit 545 may be a capacitive discharge circuit and may include a pulsed power system for driving the electromagnetic functions of electromagnetic restraint release system 540.

Figure 6:
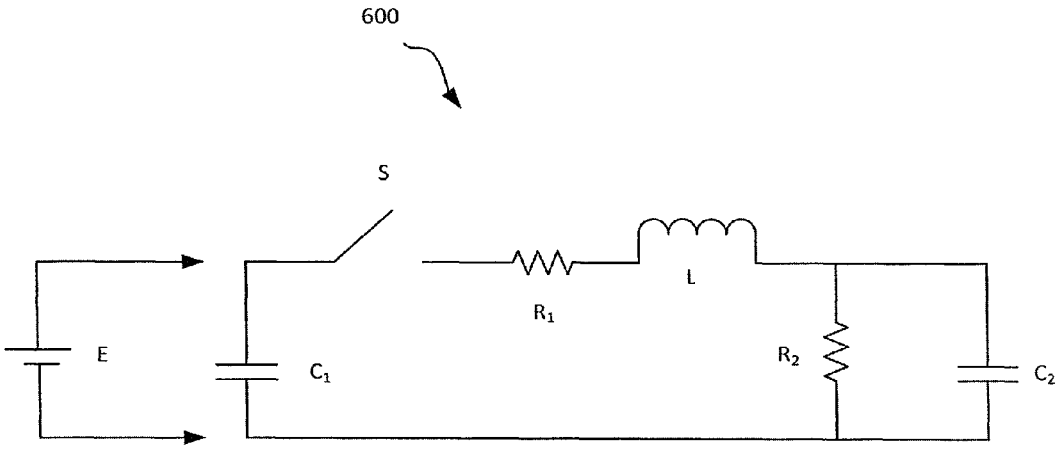
FIG. 6 shows diagrammatically a capacitive discharge circuit according to various embodiments of the disclosed subject matter.

As is shown diagrammatically in FIG. 6, capacitive discharge circuit 600 may include, for example, a capacitor $C_1$ for storing energy, a device E—e.g., a high-voltage power supply—for charging capacitor $C_1$, a switch S to apply the energy to the load, series resistance $R_1$ and/or inductance L, which are either parasitic or added for pulse shape control, load resistance $R_2$, and load capacitance $C_2$. Capacitive discharge circuit 600 may be used in conjunction with electromagnetic restraint release system 500 and may include a pulsed power system for driving the electromagnetic functions of restraint release system 540.

In response to a flow of electric current, and the resulting electromagnetic force, retaining member 548 can expand in length and relax its compressive or binding hold on segments 544. In this expanded configuration (not shown, but similar to that shown in FIG. 4), an outer peripheral dimension of retaining member 548 may be larger relative to the outer peripheral dimension associated with its prior restrained configuration. In lieu of the radially inward force previously exerted on segments 544, retaining member 548 may exert a radially outward force on segments 544 that tends to pull the segments apart. Segments 544 can in turn, release their collective hold on male fastener member 546. Accordingly, the release function of electromagnetic restraint release system 540 can be actuated.

Retaining member 548 may be optionally configured with one or more fusible links (not shown). The electrical fusible link can be constructed, for example, with a relatively short section or length of retaining member 548 having a cross-sectional area that is smaller than the remainder of retaining member 548. In response to the flow of electric current, the fusible link portion of retaining member 548 can disintegrate, and further serve to relax the compressive hold retaining member 548 exerts on segments 544 of fastener member 542.

Figure 7:
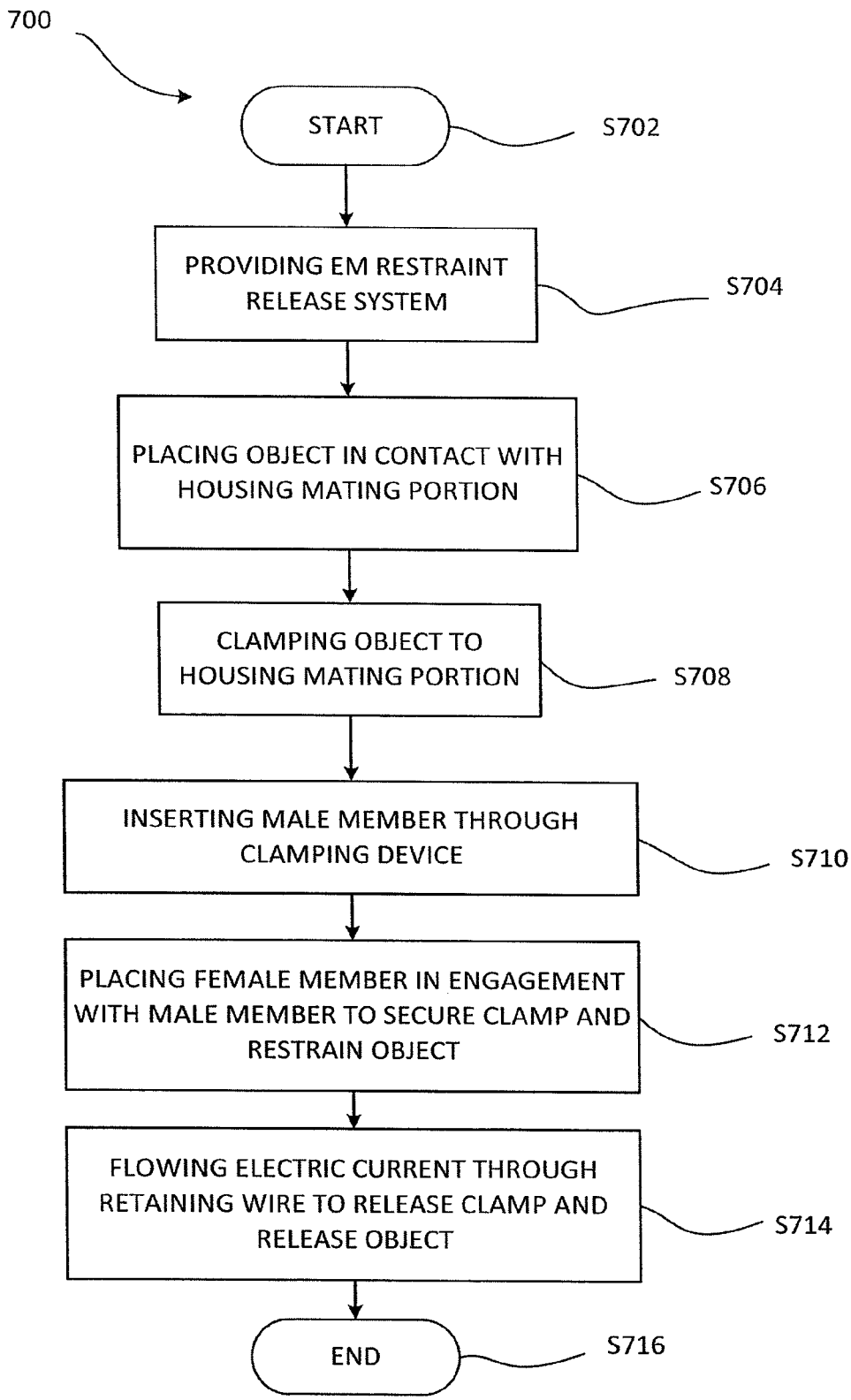
FIG. 7 shows a flow chart of a method according to various embodiments of the disclosed subject matter.

FIG. 7 shows a flow chart for a method according to various embodiments of the disclosed subject matter. Methods [700] according to embodiments of the disclosed subject matter can begin [S702] and may proceed to providing an electromagnetic (EM) restraint release system configured for releasably restraining a deployable object such as described herein [S704]. Methods can also include placing the deployable object in contact with a mating portion of the housing, the deployable object being in a stowed or restrained configuration [S706]. Placing the deployable object in contact with a mating portion of the housing may include performing alignment operations. After the deployable object has been placed in contact with the mating portion of the housing, the mating portion of the housing can be clamped to a corresponding portion of the deployable object using a clamping device such as described herein [S708]. After the mating portion of the housing has been clamped to a corresponding portion of the deployable object, the threaded male member can be inserted through the one or more through holes in the clamping device [S710]. The segmented female member can then be placed in threaded engagement with a threaded portion of the male member to tighten the clamping device and secure the deployable object to the housing, thus releasably restraining the deployable object [S712]. Methods can also include flowing an electric current through the retaining wire using a discharge circuit such as described herein, so that an electromagnetic force is generated and acts upon the retaining wire, the retaining wire releases its bind on the plurality of segments, the plurality of segments are no longer grouped together, the female member is no longer in threaded engagement with a threaded portion of the male member, the clamping device is released, and the deployable object is no longer secured to the housing and is thus no longer restrained [S714]. The method may then end [S716].

Figure 8:
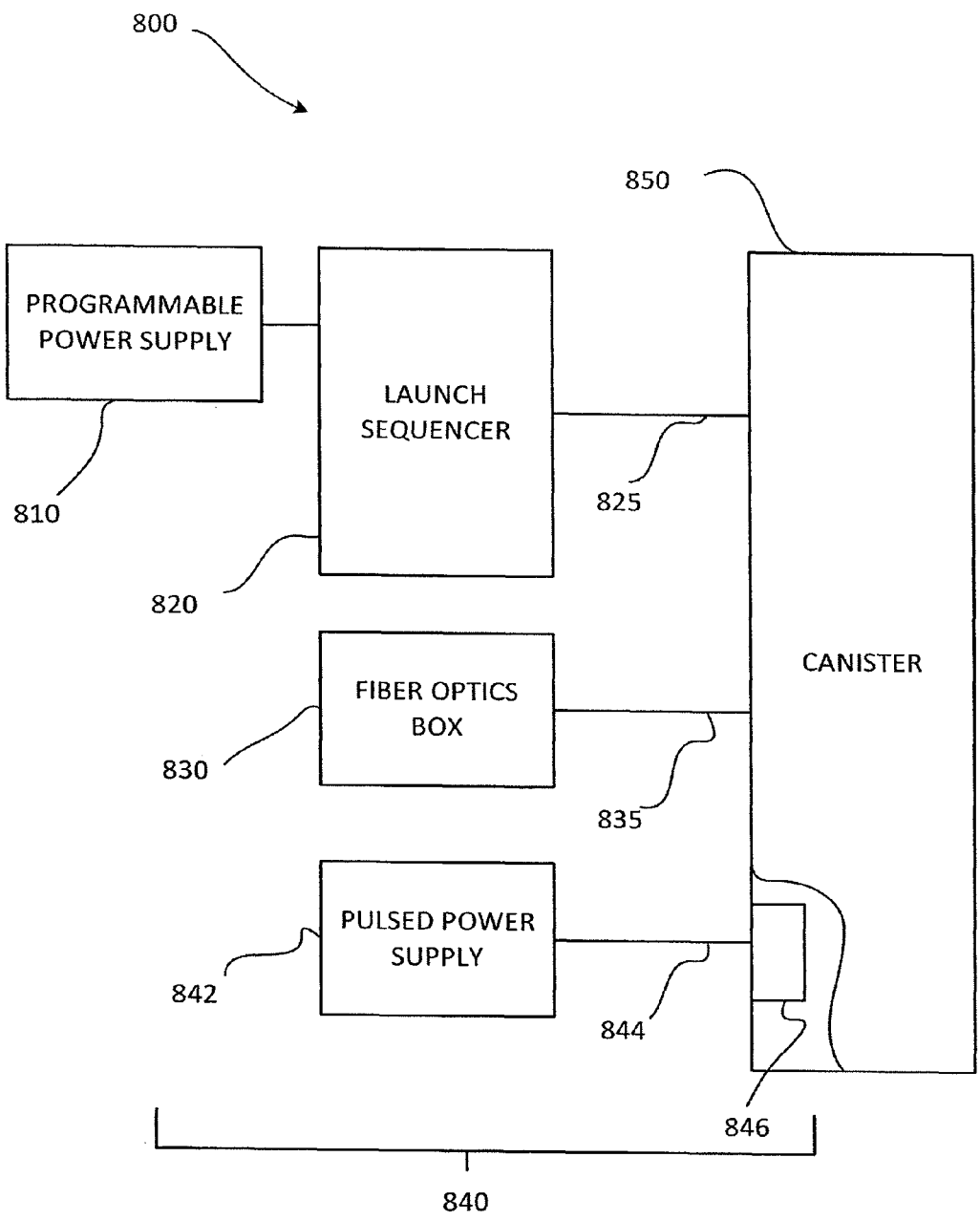
FIG. 8 shows diagrammatically a launch system that includes an electromagnetic restraint release system for releasably holding a launch object according to various embodiments of the disclosed subject matter.

FIG. 8 diagrammatically shows a launch system that includes an electromagnetic restraint release system for releasably holding a launch object. Launch system 800 may include a programmable power supply 810, a launch sequencer 820, a fiber optics box 830, and a pulsed power supply 842. Elements 810-830 may be collectively referred to as a launch control subsystem 860. Launch system 800 may also include a canister or launch container 850, a pin discrete interface 825 between launch sequencer 820 and canister 850, a fiber optics interface 835 between fiber optics box 830 and canister 850, and a pulse power interface 844 between pulsed power supply 842 and canister 850. Launch system 800 may also include electromagnetic restraint release system 840, which in turn may include pulsed power supply 842, pulse power interface 844, and electromagnetic restraint release device 846.

Having now described embodiments of the disclosed subject matter, it should be apparent to those skilled in the art that the foregoing is merely illustrative and not limiting, having been presented by way of example only. Thus, although particular configurations have been discussed herein, other configurations can also be employed. Numerous modifications and other embodiments (e.g., combinations, rearrangements, etc.) are enabled by the present disclosure and are within the scope of one of ordinary skill in the art and are contemplated as falling within the scope of the disclosed subject matter and any equivalents thereto. Features of the disclosed embodiments can be combined, rearranged, omitted, etc., within the scope of the disclosed subject matter to produce additional embodiments. Furthermore, certain features may sometimes be used to advantage without a corresponding use of other features. Accordingly, applicants intend to embrace all such alternatives, modifications, equivalents, and variations that are within the spirit and scope of the disclosed subject matter.

What is claimed is:

1. A launch system comprising an electromagnetic restraint release system adapted to hold releasably a launch object, the restraint release system comprising:

a housing configured to restrain the launch object, the housing including a mating portion for connecting to the launch object;

a clamping member configured to hold the mating portion of the housing to a corresponding portion of the launch object, the clamping member having one or more through holes for receiving a threaded male member;

a segmented female member having a plurality of threaded segments grouped radially around a central axis to form a threaded through hole configured to receive and hold the male member in releasable engagement;

a retaining member disposed around an outer periphery of the plurality of segments and configured to bind the plurality of segments together; and means for providing an electromagnetic force to the retaining member, wherein the retaining member is configured to release its bind on the plurality of segments when the retaining member receives the electromagnetic force, and wherein the plurality of segments is configured to release its engagement with the male member when the retaining member releases its bind on the plurality of segments.

2. The launch system of claim 1, wherein the retaining member is configured such that a first outer peripheral dimension of the retaining member is changed to a larger second outer peripheral dimension when the retaining member receives the electromagnetic force.

3. The launch system of claim 1, wherein the retaining member is disposed within a recess formed in the outer periphery of the plurality of segments.

4. The launch system of claim 1, wherein the means for providing an electromagnetic force comprises a pulsed power system.

5. The launch system of claim 1, wherein the launch object is one of a projectile, missile, launch vehicle, and space vehicle.

6. The launch system of claim 1, wherein the retaining member comprises one of a wire, ring and band.

7. The launch system of claim 1, wherein the retaining member encapsulates a major portion of the outer peripheral surface of the female member.

8. An electromagnetic restraint release system configured for releasably restraining a deployable object, the restraint release system comprising:

a restraining member configured to restrain the deployable object, the restraining member including a mating portion for connecting to the deployable object;

a segmented female member having a plurality of segments grouped radially around a central axis to form a through hole configured to receive and hold a male member in releasable engagement, the male member and the female member being configured to secure the mating portion of the restraining member to a corresponding portion of the deployable object when the male member and the female member are in the releasable engagement;

a retaining wire disposed around an outer periphery of the plurality of segments, configured to hold the plurality of segments together and configured to receive an electric current; and a discharge circuit configured to flow electric current through the retaining wire, wherein the retaining wire is configured to release its hold on the plurality of segments when the retaining wire receives the flow of electric current, and wherein the plurality of segments is configured to release its engagement with the male member when the retaining wire releases its hold on the plurality of segments.

9. The electromagnetic restraint release system of claim 8, wherein the retaining wire is configured such that a first outer peripheral dimension of the retaining wire is changed to a larger second outer peripheral dimension when the retaining wire receives the flow of electric current.

10. The electromagnetic restraint release system of claim 9, wherein the retaining wire includes at least one fusible link and is configured such that a portion of the retaining wire disintegrates when the retaining wire receives the flow of electric current.

11. The electromagnetic restraint release system of claim 8, wherein the retaining wire is disposed within a recess formed in the outer periphery of the plurality of segments.

12. The electromagnetic restraint release system of claim 8, wherein the discharge circuit comprises a pulsed power system adapted to drive electromagnetic functions of the restraint release system.

13. The electromagnetic restraint release system of claim 8, wherein the deployable object is one of a projectile, missile, launch vehicle, and space vehicle.

14. The electromagnetic restraint release system of claim 8, wherein the retaining wire encapsulates a major portion of the outer peripheral surface of the female member.

15. A method of releasably restraining a deployable object, the method comprising:

providing a housing configured to restrain the deployable object, the housing including a mating portion configured to connect to the deployable object;

providing a clamping member configured to hold the mating portion of the housing to a corresponding portion of the deployable object, the clamping member having one or more through holes configured to receive a male member;

providing an electromagnetic restraint release system configured for releasably restraining the deployable object, the restraint release system comprising:

a female member having a plurality of segments grouped radially around a central axis to form a through hole configured to receive and hold the male member in releasable engagement;

a retaining wire disposed around an outer periphery of the plurality of segments, configured to bind the plurality of segments together and configured to receive an electric current; and a discharge circuit configured to flow electric current through the retaining wire;

placing the deployable object in contact with a mating portion of the housing, the deployable object being in a stowed or restrained configuration;

clamping the mating portion of the housing to the corresponding portion of the deployable object using the clamping device;

inserting the male member through the one or more through holes in the clamping device; and placing the female member in releasable engagement with the male member to secure the deployable object to the housing, thus releasably restraining the deployable object.

16. The method of claim 15, further comprising:

flowing an electric current through the retaining wire using the discharge circuit, so that the retaining wire releases its bind on the plurality of segments, the plurality of segments are no longer grouped together, the female member is no longer in engagement with the male member, and the deployable object is no longer secured to the housing and is thus no longer restrained.

17. The method of claim 16, wherein the retaining wire is configured such that a first outer peripheral dimension of the retaining wire is changed to a larger second outer peripheral dimension when the retaining wire receives the flow of electric current.

18. The method of claim 17, wherein the retaining wire includes at least one fusible link and is configured such that a portion of the retaining wire having the at least one fusible link disintegrates when the retaining wire receives the flow of electric current.

19. The method of claim 15, wherein the retaining wire is disposed within a recess formed in the outer periphery of the female member.

20. The method of claim 15, wherein the retaining wire encapsulates a major portion of the outer peripheral surface of the female member.

21. An electromagnetic device adapted to releasably engage a male member in a restraint mechanism, the device comprising:

a plurality of segments disposed radially around a central axis in a grouped relation to form an internal through hole configured to receive and hold the male member; and a retaining member disposed circumferentially around the plurality of segments to hold the plurality of segments in the grouped relation and configured to receive an electric current, wherein the retaining member is configured to release its hold on the plurality of segments when the retaining member receives the electric current, and wherein the plurality of segments is configured to release its hold on the male member when the retaining member releases its hold on the plurality of segments.

22. The electromagnetic device of claim 21, wherein the retaining member is configured such that a first outer peripheral dimension of the retaining member is changed to a larger second outer peripheral dimension when the retaining member receives the electric current.

23. The electromagnetic device of claim 22, wherein the retaining member includes at least one fusible link and is configured such that a portion of the retaining member disintegrates when the retaining member receives the electric current.

24. The electromagnetic device of claim 21, wherein the retaining member is disposed within a recess formed in the outer periphery of the plurality of segments.

* * * * *